US006585539B2

(12) United States Patent
Ishikawa

(10) Patent No.: US 6,585,539 B2
(45) Date of Patent: Jul. 1, 2003

(54) PANEL ATTACHMENT CONFIGURATION FOR A CONNECTOR

(75) Inventor: Ryotaro Ishikawa, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/986,706

(22) Filed: Nov. 9, 2001

(65) Prior Publication Data

US 2002/0058440 A1 May 16, 2002

(30) Foreign Application Priority Data

Nov. 10, 2000 (JP) ..... 2000-344193

(51) Int. Cl.[7] ..... H01R 13/73

(52) U.S. Cl. ..... 439/565; 439/569; 439/378; 439/680; 439/556

(58) Field of Search ..... 439/565, 569, 439/557, 552, 550, 549, 680, 378

(56) References Cited

U.S. PATENT DOCUMENTS 4,220,808 A * 9/1980 Fujita ..... 174/48
5,021,009 A * 6/1991 Cox ..... 439/538
5,125,849 A * 6/1992 Briggs et al. ..... 439/378
5,249,982 A * 10/1993 Funck et al. ..... 439/556
5,472,357 A 12/1995 Yamanashi
5,487,680 A 1/1996 Yamanashi
5,660,564 A * 8/1997 Yamanashi et al. ..... 439/556

FOREIGN PATENT DOCUMENTS

JP 2-143785 12/1990

* cited by examiner

*Primary Examiner*—Tho D. Ta
(74) *Attorney, Agent, or Firm*—Banner & Witcoff, Ltd.

(57) ABSTRACT

The invention provides a simple means for preventing a panel connector from rotating. A circular attachment hole 2 opens into a panel 1, and a cylindrical hood 12 is formed on a male housing 10. An outer circumference face of this hood 12 has a flange 20 and retaining claws 22 and 23 formed thereon. A position fixing pin 3 protrudes from a hole edge of the attachment hole 2 at an innermost face thereof, and a position fixing recess 28 opens onto an outer circumference edge of the flange 20. A protrusion 31 protrudes from an anterior end of the hood 12 at a side thereof opposite the side provided with the position fixing recess 28. The male housing 10 is inclined, and the protrusion 31 is fitted into the hole edge of the attachment hole 2. Then the male housing 10 is returned to its straight state, using the protrusion 31 as a fulcrum, and the position fixing pin 3 is passed through the position fixing recess 28 from an insertion opening 29 thereof opening onto the outer circumference edge of the flange 20. The male housing 10 is inserted smoothly through the attachment hole 2 and is maintained in a prescribed position whereby it is prevented from rotating.

13 Claims, 8 Drawing Sheets

PANEL ATTACHMENT CONFIGURATION FOR A CONNECTOR

TECHNICAL FIELD

The present invention relates to a configuration for attaching an electrical connector, in a waiting state, to a panel.

BACKGROUND TO THE INVENTION

In one example of this type of attachment configuration, an outer circumference face of a connector housing is provided with a flange, and retaining claws are formed to the anterior thereof. After the connector housing has been passed through an attachment hole opening into a panel, the flange and the retaining claws grip sides of a hole edge of the attachment hole. This attaches the connector housing to the panel in a waiting state whereby a corresponding connector can be fitted to the connector housing.

The waiting connector should be attached in a manner whereby it is fixed in position and does not rotate, so that the corresponding connector can conveniently be attached thereto. For example, the attachment hole of the panel and the outer shape of the connector housing may be formed in an angular shape (e.g., a square shape). In such a case, the connector housing is naturally fixed in position such that it does not rotate. However, when the attachment hole and the connector housing have a circular shape, another means to fix the waiting connector in position must be found.

The present invention has taken the above problem into consideration, and aims to present a simple means for preventing the connector from rotating.

SUMMARY OF THE INVENTION

According to the invention there is provided a panel connection assembly comprising a panel having a circular aperture therein and an electrical connector for insertion and retention in said aperture, said connector comprising a housing having a through member at the anterior side and adapted to fit tightly in said circular aperture, a flange to limit insertion into said aperture and retaining claws engageable with the edge of said aperture to retain said connector therein, said panel having a retaining member protruding from the side facing said flange, said flange having an opening in the periphery thereof adapted to receive said retaining member, and said housing having a protrusion protruding from the anterior side thereof away from said flange. Such an arrangement permits easy guiding and fixing of a circular panel connector.

In the preferred embodiment the opening is a recess having a widened mouth, and the retaining member is an upstanding cylindrical pin. The protruding portion of the through member is advantageously opposite to the opening, and may be provided on a circumferentially continuous hood.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

An embodiment of the present invention is described below with the aid of FIGS. 1 to 8.

Figure 1:
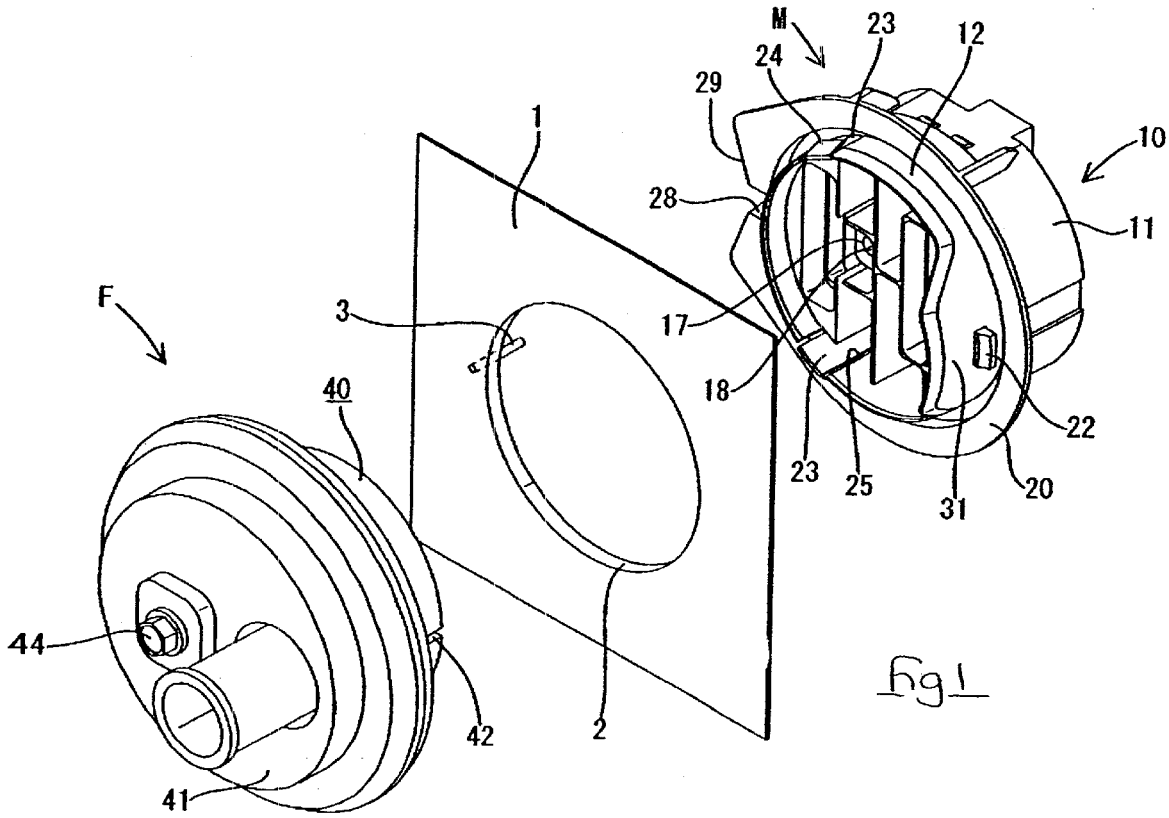
FIG. 1 is a disassembled diagonal view of an embodiment of the present invention.

As shown in FIG. 1, the present embodiment has a circular attachment hole 2 in a panel 1. A male connector M is pushed, from an innermost face of the panel 1, through the attachment hole 2, thereby being attached to the panel 1 in a waiting state. A corresponding female connector F can be fitted to the male connector M from the outermost face of the panel 1.

Figure 2:
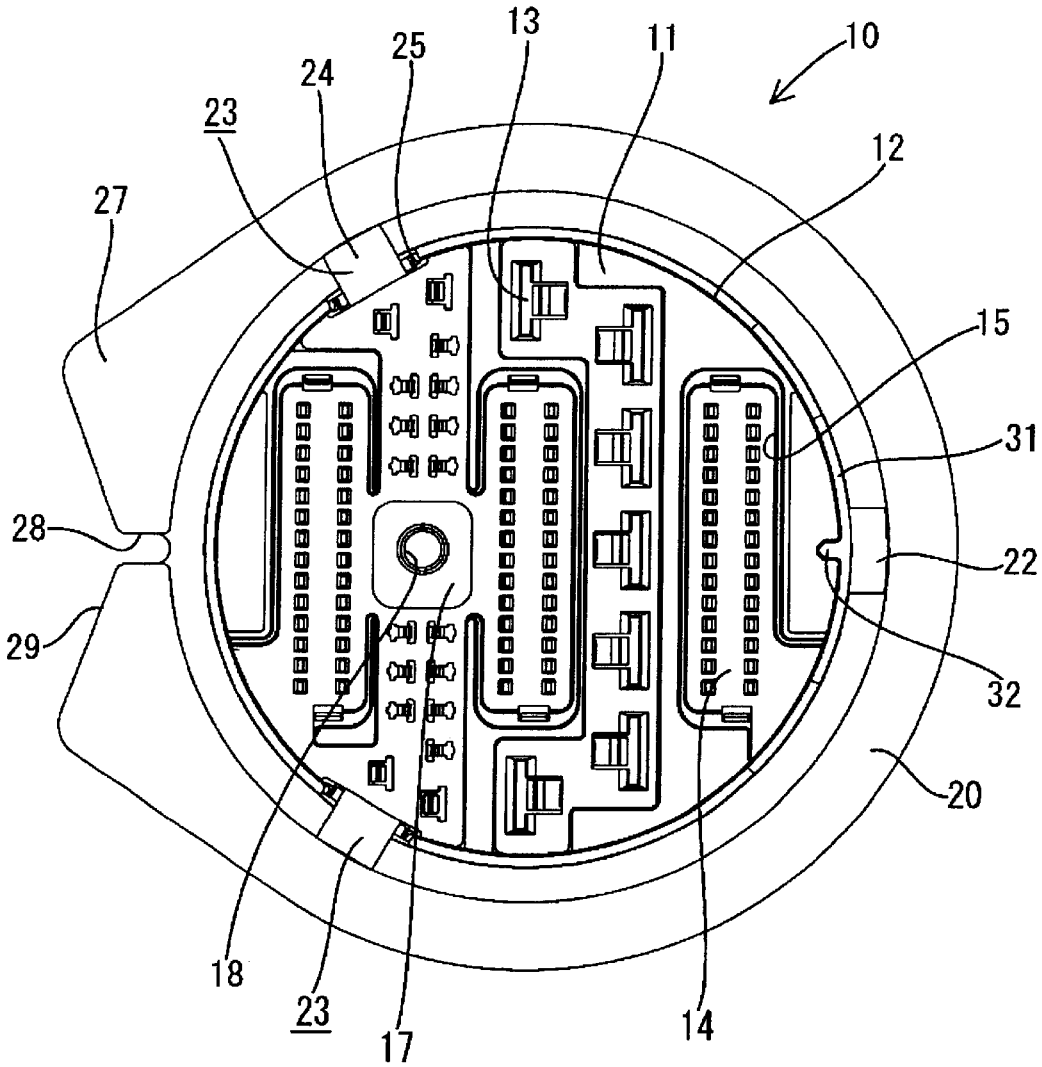
FIG. 2 is a front view of a male housing.
Figure 3:
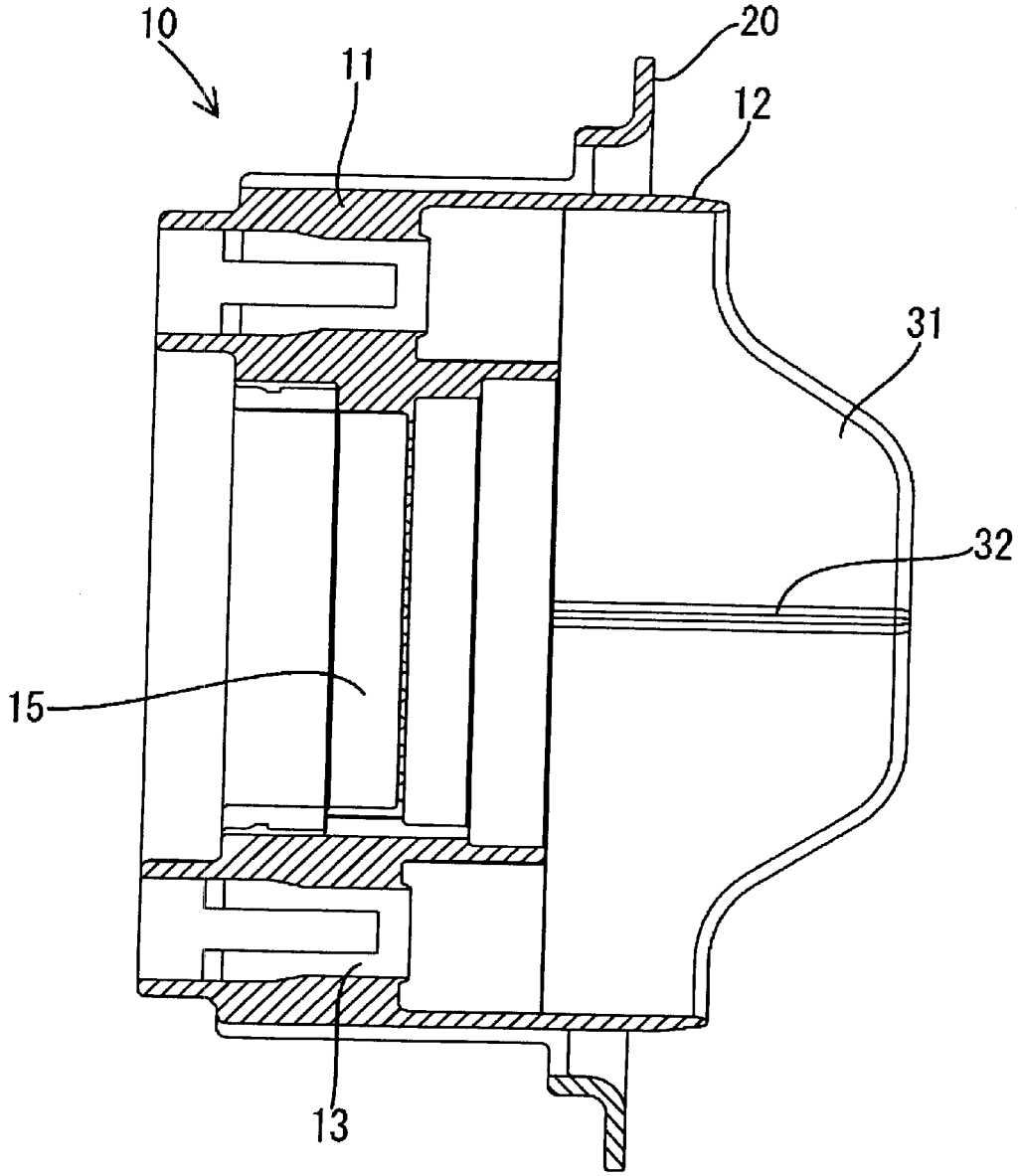
FIG. 3 is a cross-sectional view of the male housing.
Figure 4:
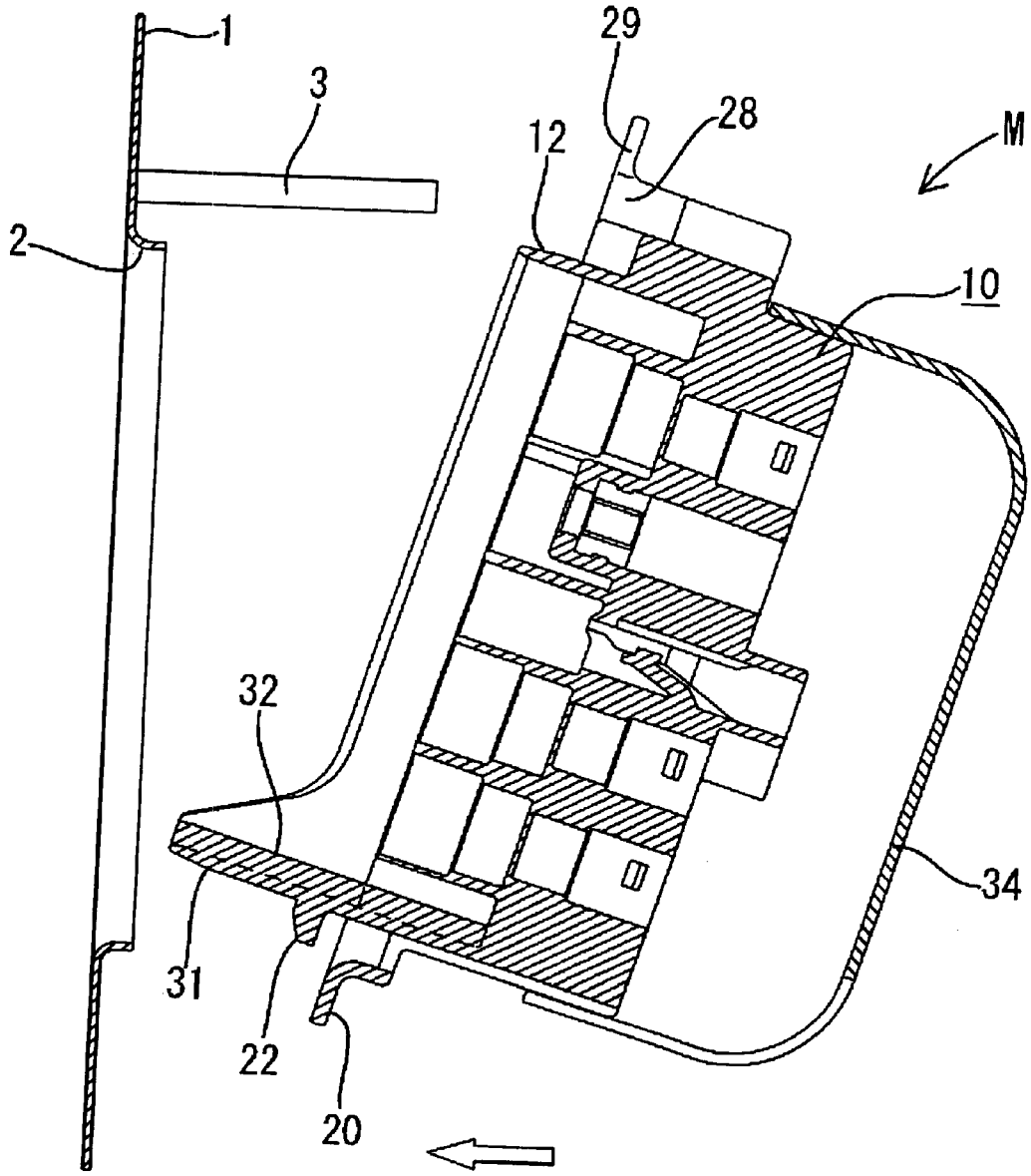
FIG. 4 is a vertical cross-sectional view showing a male connector immediately prior to being passed through an attachment hole of a panel.
Figure 5:
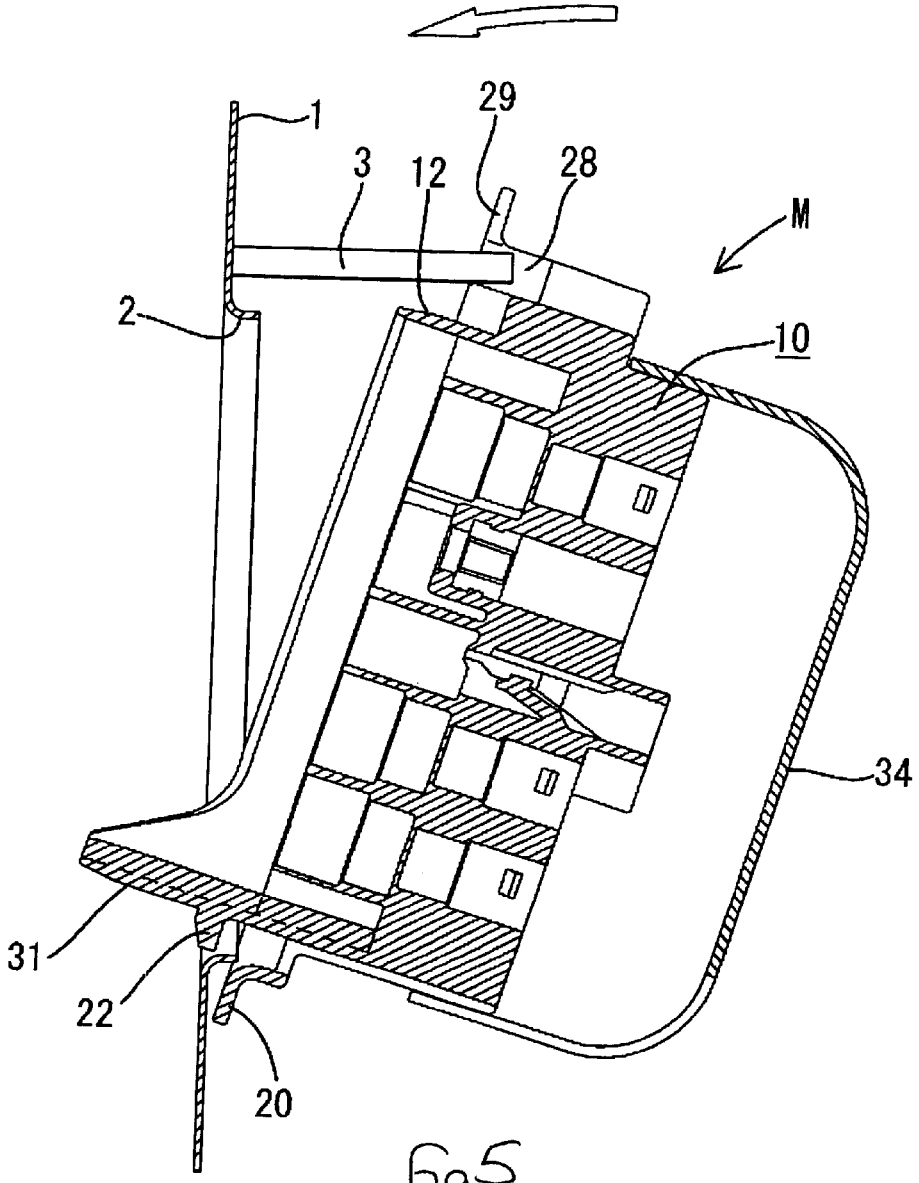
FIG. 5 is a vertical cross-sectional view of a protrusion within the attachment hole.

The male connector M is made from plastic, and has a male housing 10. As shown in FIGS. 2 and 3, the male housing 10 has a main body 11 and a cylindrical hood 12 that is provided at an anterior face of the main body 11 and can fit tightly into the attachment hole 2 of the panel 1. The main body 11 is provided with attachment holes 15, and cavities 13 for housing large male terminal fittings. Sub housings 14, in which small male terminal fittings are housed, are attached within the attachment holes 15. A fastening member 17 is provided on the male housing 10, this fastening member 17 having a screw hole 18 for a bolt 44. This bolt 44 is used to fasten the male connector M and the corresponding female connector F together and to maintain them in a fitted state.

A flange 20 is formed along an outer circumference face of the hood 12 at a location slightly towards the posterior from an anterior end thereof. This flange 20 has a stepped shape whereby an outer circumference member thereof protrudes outwards at its anterior side. Three retaining claws are formed at the anterior end of the hood 12. These retaining claws are separated by equally spaced intervals and engage with a hole edge of the attachment hole 2 at an outermost face of the panel 1. The retaining claw on the right in FIG. 2 is a fixed retaining claw 22 that is formed in a unified manner with the hood 12. The retaining claws on the left lower side and left upper side in FIG. 2 are movable retaining claws 23. These movable retaining claws 23 are made from metal strips whose tips are bent in a peaked shape to form claw members 24. The movable retaining claws 23 are fixed in position by means of pushing base ends thereof into the main body 11. The claw members 24 are inserted, while facing towards the anterior, along an inner circumference face of the hood 12; they are inserted in the axial direction of the hood 12. The claw members 24 protrude towards an outer side of the hood 12 via recessed grooves 25 cut into the anterior end of the hood 12. The tips of the claw members 24 are capable of bending into the interior of the hood 12.

A position fixing pin 3 protrudes from the hole edge of the attachment hole 2 at the innermost face side of the panel 1, this position fixing pin 3 being located on the left side with reference to the outermost face of the panel 1.

A portion of the flange 20 of the male housing 10 protrudes to form a protruding portion 27 that is located on the left side relative to a front view of the male housing 10. A position fixing recess 28, through which the position fixing pin 3 can pass, is formed in the protruding portion 27. The position fixing recess 28 is groove-like and is open to an outer circumference edge of the protruding portion 27, this opening forming an insertion opening 29 that is wide so that the position fixing pin 3 can be guided therein from the outer side of the position fixing recess 28.

A protrusion 31, which protrudes in an anterior direction, is formed on the anterior end of the hood 12 of the male housing 10, being formed on the right side thereof relative to the front view of the male housing 10. This protrusion 31 forms a unified face with a circumference face of the hood 12 and, as shown in FIG. 3, is approximately trapezoidal in shape. A rib 32 is formed on an inner face of the protrusion 31 at a central location relative to the widthwise direction thereof. This rib 32 extends in an axial direction as far as a base of the hood 12. The rib 32 strengthens the protrusion 31, and performs a guiding function when a corresponding female housing 40 is fitted with the male housing 10.

Figure 8:
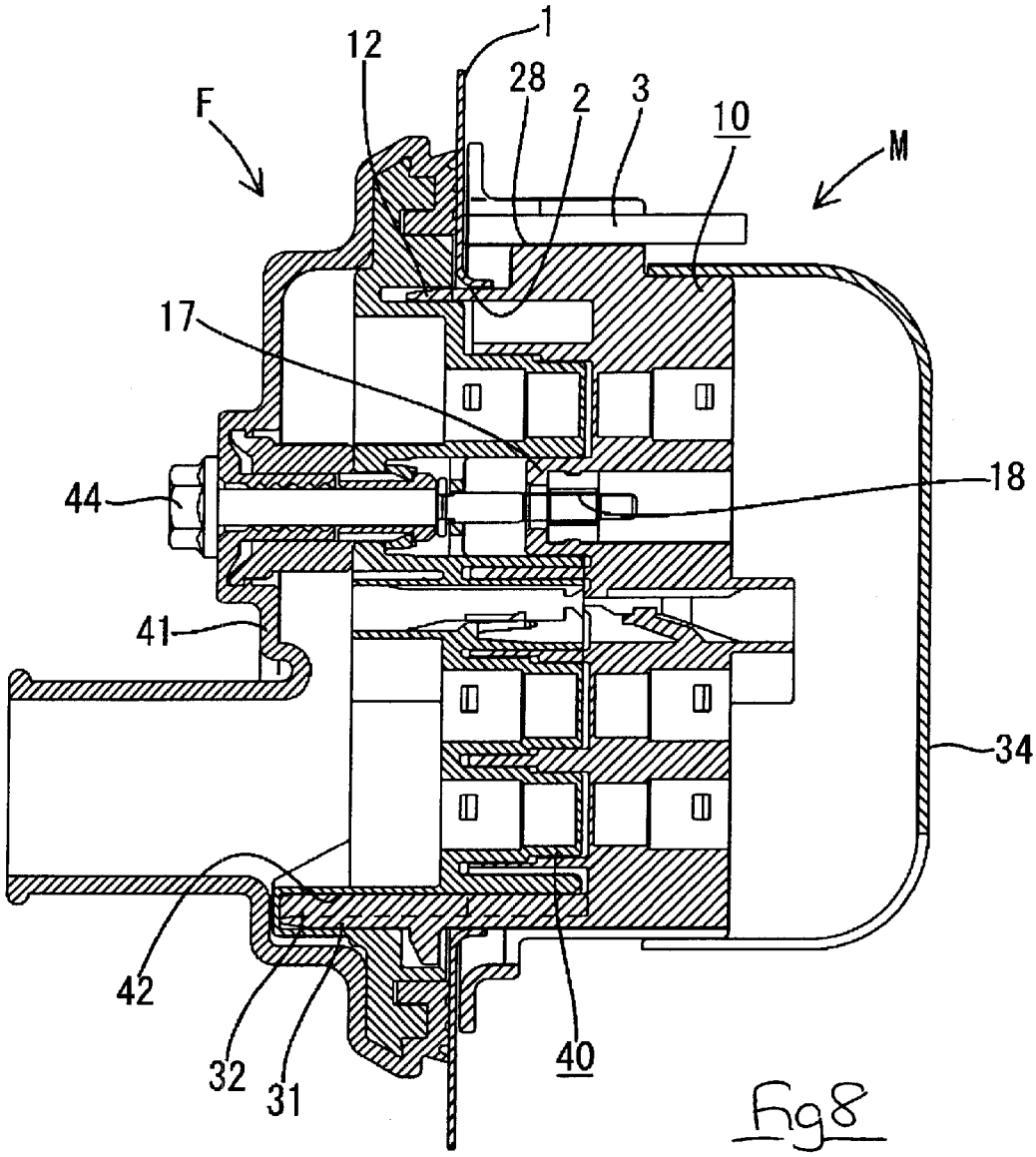
FIG. 8 is a vertical cross-sectional view of the male connector fitted with a corresponding female connector.

As shown in FIGS. 1 and 8, the corresponding female connector F is provided with the female housing 40 that can be fitted tightly into the hood 12 of the male housing 10. Female terminal fittings are housed within the female housing 40, and a rubber cover 41 is attached to a posterior face of the female housing 40. This rubber cover 41 houses electric wires and leads them outwards in one direction, and also waterproofs the female housing 40. A guiding groove 42 is formed at a specified location in an outer circumference face of the female housing 40. This guiding groove 42 extends in an axial direction and fits together with the rib 32 of the protrusion 31 of the male housing 10. The bolt 44, for fastening the male housing 10 and the female housing 40 together, is attached to the female housing 40.

Next, the operation of the present embodiment will be described. The male terminal fittings and the sub connectors 14 are attached within the main body 11 of the male housing 10. Furthermore, a cover 34 is attached to a posterior face of the male housing 10. Next, as shown in FIG. 1, the male housing 10 is rotated at the innermost face side of the panel 1 so that the position fixing recess 28 of the flange 21 is located on the left (relative to the front view thereof). Further, the male housing 10 is inclined so that the side thereof provided with the protrusion 31 protrudes towards the anterior (see FIG. 4), and the hood 12 of the male housing 10 is inserted into the attachment hole 2 in the direction shown by the arrow in FIG. 4.

The protrusion 31 is first inserted into the attachment hole 2. When the flange 20 strikes against the innermost face of the panel 1 (see FIG. 5), the fixed retaining claw 22 reaches the hole edge of the attachment hole 2, and the position fixing pin 3 is inserted into the position fixing recess 28, being guided therein by the wider insertion opening 29. Next, the male housing 10 is rotated, as shown by the arrow in FIG. 5, using the fixed retaining claw 22 as an axis, so that the side of the male housing 10 provided with the position fixing recess 28 approaches the panel 1. The fixed retaining claw 22 is pushed to the outermost face side of the attachment hole 2, and the claw members 24 strike against the hole edge of this attachment hole 2, this bending the movable retaining claws 23 inwards. Moreover, the position fixing pin 3 is inserted into the position fixing recess 28 to a distance such that this position fixing pin 3 protrudes to the posterior thereof.

Figure 6:
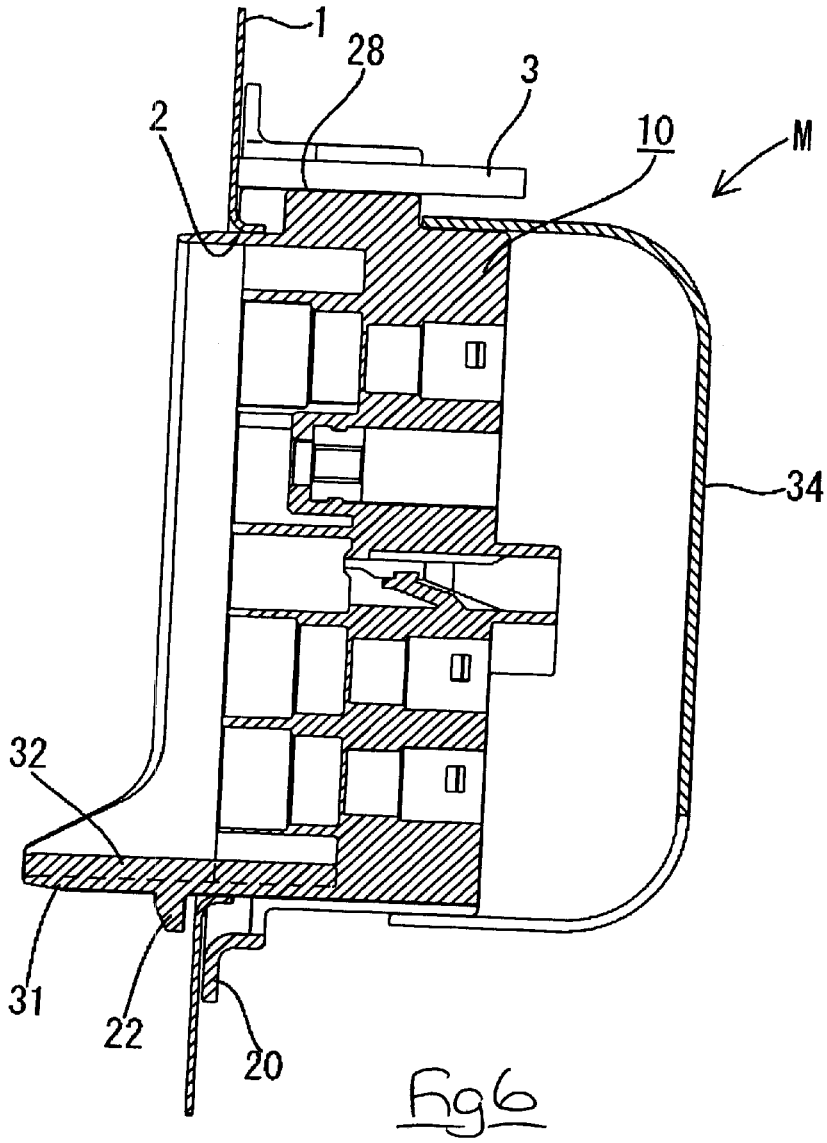
FIG. 6 is a vertical cross-sectional view showing the male connector retained within the attachment hole.
Figure 7:
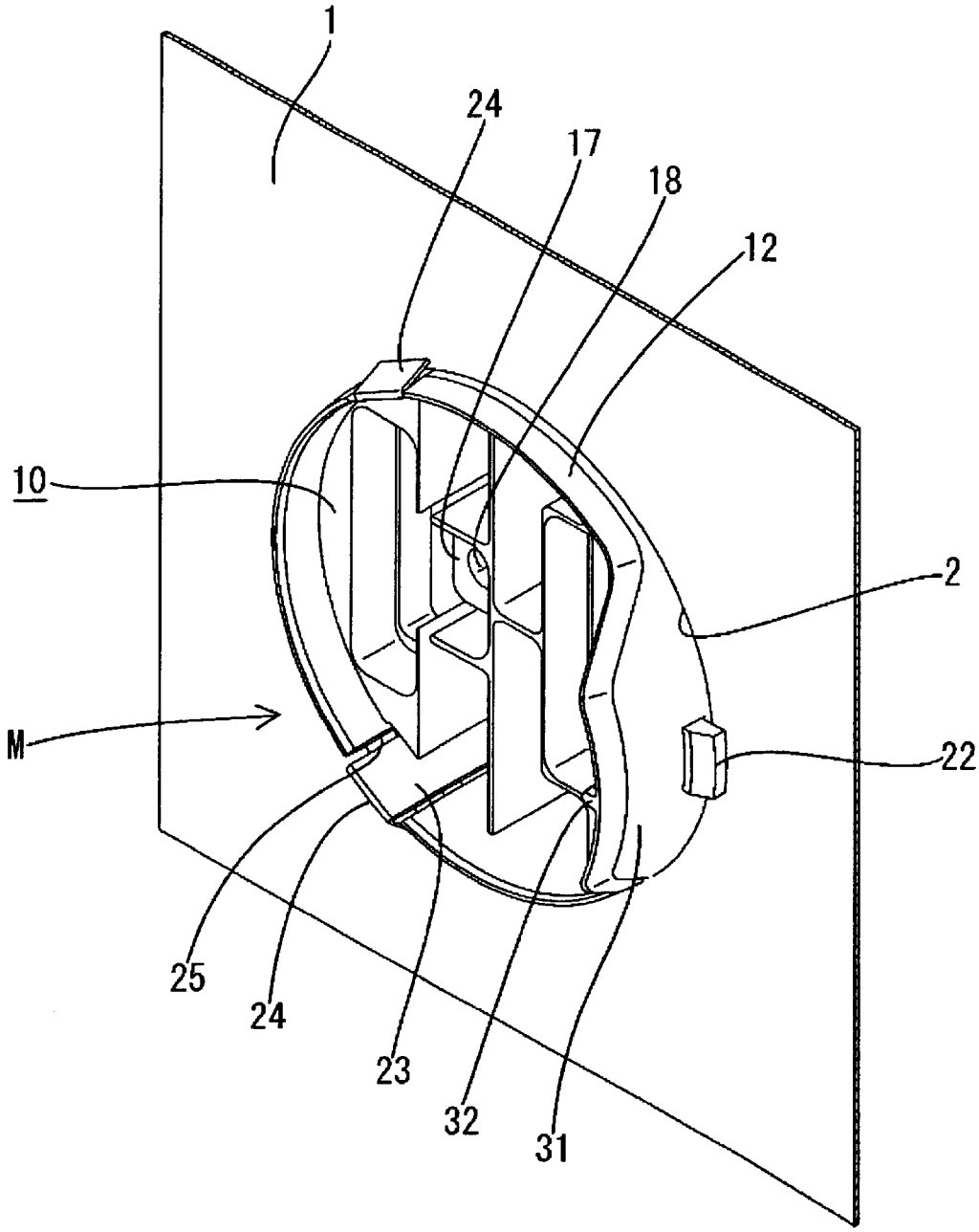
FIG. 7 is a diagonal view showing the male connector retained within the attachment hole.

As rotation continues, the side of the male housing 10 provided with the position fixing recess 28 of the flange 20 strikes against the innermost face of the panel 1 (see FIGS. 6 and 7). Then, the fixed retaining claw 22 engages with the hole edge of the attachment hole 2 at the outermost face side thereof, and the claw members 24 pass through to the outermost face side of the panel 1, the movable retaining claws 23 return outwards to their original shape, and the claw members 24 engage with the hole edge of the attachment hole 2 at the outermost face side thereof. Further, the position fixing pin 3 is in a state whereby it has been inserted into the position fixing recess 28 to a distance such that it protrudes from a posterior face thereof.

That is, the male connector M is attached in a state whereby the hole edge of the attachment hole 2 is gripped between the flange 20 on one side and the fixed retaining claw 22 and the claw members 24 of the movable retaining claws 23 on the other, thus preventing the male connector M from being removed in either the anterior or posterior direction. Furthermore, the position fixing pin 3 is passed through the position fixing recess 28 of the flange 20, this preventing the male connector M from rotating. The male connector M is thus attached to the panel 1 in a waiting state, and its rotation is prevented.

When the corresponding female connector F is to be fitted to the male connector M, the female housing 40 is brought to the inner face of the protrusion 31 such that the rib 32 will fit into the guiding groove 42. In this state, the female connector F is pushed straight into the hood 12. Finally, as shown in FIG. 8, the bolt 44 attached to the female housing 40 is screwed into the screw hole 18 of the fastening member 17 of the male housing 10, this fastening the male and female connectors M and F together in a fitted state. A circumference edge of the rubber stopper 41 resiliently grips the outermost face of the panel 1, providing a seal.

In the present embodiment, the position fixing pin 3 protruding from the panel 1 is passed through the position fixing recess 28 in the flange 20 of the male housing 10, this preventing the male housing 10 from rotating within the attachment hole 2. If the protrusion 31 were not provided, the male housing 10 might pivot at the innermost side of the attachment hole 2, with the position fixing pin 3 serving as its axis, even though the position fixing pin 3 had been passed through the position fixing hole 28. As a result, inserting the hood 12 through the attachment hole 2 would be time-consuming.

The present embodiment resolves this problem by providing the protrusion 31 which protrudes from a portion of the anterior end of the hood 12. When the position fixing pin 3 has been passed through the position fixing recess 28, the protrusion 31 is first fitted into the attachment hole 2, this allowing the hood 12 to be passed smoothly therethrough. In particular, the position fixing recess 28 opens into the circumference edge of the flange 20, and the protrusion 31 is located on the side opposite this position fixing recess 28, with the hood 12 being located between the two. Consequently, the male housing 10 is attached in the following order: the male housing 10 is first inclined in its axial direction and the protrusion 31 is attached to the hole edge of the attachment hole 2, the male housing 10 is then returned to a straight position, with the protrusion 31 serving as the pivot axis, and the position fixing pin 3 is passed through the position fixing recess 28. That is, the male housing 10 can easily and efficiently be passed through the attachment hole 2 and thereby attached. Furthermore, the protrusion 31 performs a guiding function when the corresponding female housing 40 is fitted into the hood 12. Consequently, the protrusion 31 simplifies the fitting operation of the female and male housings 40 and 10.

The present invention is not limited to the embodiments described above with the aid of figures. For example, the possibilities described below also lie within the technical range of the present invention. In addition, the present invention may be embodied in various other ways without deviating from the scope thereof.

(1) The present invention is equally suitable for a case whereby the waiting connector is female.

What is claimed is:

1. A panel connection assembly comprising a panel having a circular aperture therein and an electrical connector for insertion and retention in said aperture, said connector comprising a housing having a through member at the anterior side and adapted to fit tightly in said circular aperture, a flange to limit insertion into said aperture and retaining claws engageable with the edge of said aperture to retain said connector therein, wherein said panel has a retaining member protruding from the side facing said flange, said flange has an opening in the periphery thereof adapted to receive said retaining member, and said housing has a protrusion protruding from the anterior side thereof away from said flange at a side of said housing opposite said opening.

2. An assembly according to claim 1 wherein said protrusion protrudes from said through member.

3. An assembly according to claim 2 wherein said protrusion comprises a curved flange portion having a leading edge of substantially constant height, and a ramp on either side thereof.

4. An assembly according to claim 2 wherein said protrusion is substantially trapezoidal in shape.

5. An assembly according to claim 4 wherein said protrusion comprises a curved flange portion having a leading edge of substantially constant height, and a ramp on either side thereof.

6. An assembly according to claim 1 wherein said retaining member comprises a pin protruding substantially at right angles from said panel.

7. An assembly according to claim 1 wherein said through member comprises a circumferentially continuous hood adapted to receive a mating connector therein.

8. An assembly according to claim 1 wherein one of said retaining claws is adjacent said protrusion.

9. An assembly according to claim 8 wherein said one of said retaining claws comprises a fixed projection.

10. An assembly according to claim 1 wherein said opening comprises a peripheral recess of said flange.

11. An assembly according to claim 10 wherein said recess widens towards the mouth thereof.

12. A panel connection assembly comprising a panel having a circular aperture therein and an electrical connector for insertion and retention in said aperture, said connector comprising a housing having a through member at the anterior side and adapted to fit tightly in said circular aperture, a flange to limit insertion into said aperture, one fixed retaining claw and two resiliently movable retaining claws engageable with the edge of said aperture to retain said connector therein, said retaining claws being substantially equi-spaced, wherein said panel has a retaining member protruding from the side facing said flange, said flange has an opening in the periphery thereof adapted to receive said retaining member, and said housing has a protrusion protruding from the anterior side thereof away from said flange.

13. A panel connection assembly comprising a panel having a circular aperture therein and an electrical connector for insertion and retention in said aperture, said connector comprising a housing having a through member at the anterior side and adapted to fit tightly in said circular aperture, a flange to limit insertion into said aperture and retaining claws engageable with the edge of said aperture to retain said connector therein, wherein said panel has a retaining member protruding from the side facing said flange, said flange has a recess open to a circumferential edge thereof and adapted to receive said retaining member, and said housing has a protrusion protruding from the anterior side thereof away from said flange.

* * * * *